US005984638A

United States Patent [19]

Gresh et al.

[11] Patent Number: 5,984,638

[45] **Date of Patent: *Nov. 16, 1999**

[54] TURBOMACHINE RADIAL IMPELLER VIBRATION CONSTRAINING AND DAMPING MECHANISM

[75] Inventors: M. Theodore Gresh, Jeannette; Francis Kushner, Delmont, both of Pa.

[73] Assignee: Elliott Turbomachinery Co., Inc., Jeannette, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/289,795

[22] Filed: Aug. 12, 1994

[51] Int. Cl.[6] ..... F01D 5/24

[52] U.S. Cl. ..... 416/195; 416/194; 416/196 R

[58] Field of Search ..... 416/194, 195, 416/196 R

[56] References Cited

U.S. PATENT DOCUMENTS

| | | | |
|---|---|---|---|
| 822,801 | 6/1906 | Wilkinson | 416/196 R |
| 937,006 | 10/1909 | McKee | 416/196 R |
| 3,131,461 | 5/1964 | Miller | 29/156.8 |
| 3,527,546 | 9/1970 | Zeman | 416/196 R |
| 3,708,244 | 1/1973 | Dawson et al. | 416/196 R |
| 4,191,508 | 3/1980 | Kuroda et al. | 416/196 R |
| 4,407,634 | 10/1983 | Tones | 416/196 R |
| 4,904,158 | 2/1990 | Kun | 416/183 |

FOREIGN PATENT DOCUMENTS

| | | | |
|---|---|---|---|
| 0818806 | 10/1951 | Germany | 416/196 R |
| 1164752 | 3/1964 | Germany | 416/196 R |
| 0398665 | 1/1974 | Russian Federation | 416/196 R |
| 1309646 | 3/1973 | United Kingdom | 416/196 R |
| 1499586 | 2/1978 | United Kingdom | 416/196 R |
| 2033492 | 5/1980 | United Kingdom | 416/196 R |

*Primary Examiner*—Christopher Verdier

*Attorney, Agent, or Firm*—Webb Ziesenheim Logsdon Orkin & Hanson, P.C.

[57] ABSTRACT

A compressor blade vibration reduction mechanism for a high-speed radial impeller for minimizing fatigue failures from various excitation sources. The vibration reduction mechanism includes a plurality of loose-fitting lashing pins coupling each impeller blade to an adjacent impeller blade. Each lashing pin extends through a first aperture in a blade located adjacent to the blade tip and through a second aperture of an adjacent blade. The second aperture of each blade is located a greater distance from the leading edge of the blade than the first aperture. The second aperture is located in an area of the blade having lower vibration during operation than the blade location where the first aperture is located.

5 Claims, 2 Drawing Sheets

TURBOMACHINE RADIAL IMPELLER VIBRATION CONSTRAINING AND DAMPING MECHANISM

BACKGROUND OF THE INVENTION

1. Field of the Invention

The invention relates generally to bladed turbomachinery and more specifically to a vibration reduction mechanism for a high-speed radial impeller to reduce or eliminate fatigue failures resulting from various excitation sources.

2. Background Information

Radial impeller blades are subjected to alternating forces from various sources including, for example, surge forces, stall forces, harmonic resonance, the presence of inlet vanes and valves, turbulence within the system and the like. The response for each vibratory mode of the blades is a function of the strength of the excitation force, the material properties of the blade and the vibration damping characteristics of the blade.

Vibration of the blades is a frequent cause of blade failure due to the creation of bending stresses in the blades. When these bending stresses exceed the maximum allowable values of the blade material, a crack will often develop. As such a crack enlarges under continued stress, a point is reached where the entire blade fractures and a substantial portion of the blade is loose within the machine. Machines of this type often operate at very high rotary speeds wherein a broken blade part can create substantial damage to the machinery.

In addressing this problem, the prior art has lashed impeller blades together to damp the vibration of the blades. Prior art lashings have taken several forms. For example, all of the blades have been lashed together by a single ring of material successively secured to each blade. This type of lashing is not always feasible due partly to the enlargement of the blade diameter during rotation of the impeller which imposes bending or hoop stress on the lashing member and self-imposed stresses resulting in a failure in the lashing member.

U.S. Pat. No. 3,131,461 to Miller discloses a lashing construction for damping blade vibrations in axial flow turbomachinery wherein each blade is lashed to its adjacent blades by a pair of solid pins extending between and connected to the two adjacent blades. In axial flow turbomachinery, such as illustrated in the Miller patent, due to the cantilevered, tapered blade construction the vibration across the tip of the blade is substantially the same. The difficulties with the axial impeller lashing system disclosed in the Miller patent include the fact that the system does not consider the vibration amplitude of the relative blade connecting positions. The Miller patent lashing system locates the connecting positions of each blade to an adjacent blade at points where the vibration of each blade can be equal and in phase and thus not able to provide frictional damping limiting effectiveness of the system.

The object of the present invention is to overcome the aforementioned drawbacks of the prior art.

SUMMARY OF THE INVENTION

The object of the present invention is achieved by providing a radial impeller system which includes an impeller shaft, a plurality of impeller blades positioned at spaced locations around the circumference of the impeller shaft and a plurality of lashing pins coupling adjacent impeller blades to each other. Each blade includes a first lashing pin aperture adjacent to the blade tip and a second lashing pin aperture located on the blade at an area of the blade having a lower vibration during operation of the impeller system than in the area of the blade where the first lashing pin aperture is located. Relative vibratory deflection between the two apertures can be determined by physically testing or by analytically determining, such as by finite element analysis, each natural mode. Each lashing pin extends from a first lashing pin aperture in one of the impeller blades to a second lashing pin aperture in an adjacent impeller blade.

The first lashing pin aperture in each blade is located at a lesser distance in the axial/tangential plane from the leading edge of the blade than the distance of the second lashing pin aperture from the leading edge of the adjacent blade, thereby forming a progressive zigzag pattern around the impeller blades. The individual lashing pins of the present invention may be hollow to reduce the stresses within the individual lashing pins.

Each lashing pin extends through first and second lashing pin apertures. Each lashing pin may include a fixed head at the end thereof with the fixed head having a diameter greater than the diameter of the first and second lashing pin apertures. One of the fixed heads may be formed integral with the lashing pin. Each lashing pin is loosely fitted within the first and second lashing pin apertures, whereby the impeller blade can move relative to the lashing pin after overcoming the frictional forces therebetween.

The present invention provides a method of reducing bending blade vibrations for a high-speed radial impeller having cantilevered blades. The method includes the steps of providing a first aperture in each blade adjacent to the leading edge of the blade, and providing a second aperture in each blade in a position on the blade having lower vibration during operation than the vibration of the area having the first aperture. A lashing pin is inserted through the first aperture in one blade and through the second aperture in an adjacent blade. The lashing pin is loosely fitted within the first and second apertures. Fixed heads are secured to the opposed ends of the lashing pins and each head has an end portion with a diameter greater than the diameter of the first and second apertures. The fixed head may be welded to one or both ends of the lashing pin. The longitudinal center of each lashing pin may be bored out to reduce the stresses on the lashing pin during rotation of the impeller. The gap between the fixed head and an adjacent blade during nonuse or in a static condition of the impeller can be adjusted by canting the respective blade. At operating speed, the steady state deflection at each aperture location will be different and the gap may be modified with canted blades at static conditions. The second aperture of each blade is positioned at a greater axial/tangential distance from the leading edge of the respective blade than the first aperture, thereby creating a progressive zigzag pattern of pins about the impeller blades.

These and other advantages of the present invention will be clarified in the description of the preferred embodiments taken in connection with the attached figures wherein like reference characters refer to like elements throughout.

DESCRIPTION OP THE PREFERRED EMBODIMENTS

Figure 1:
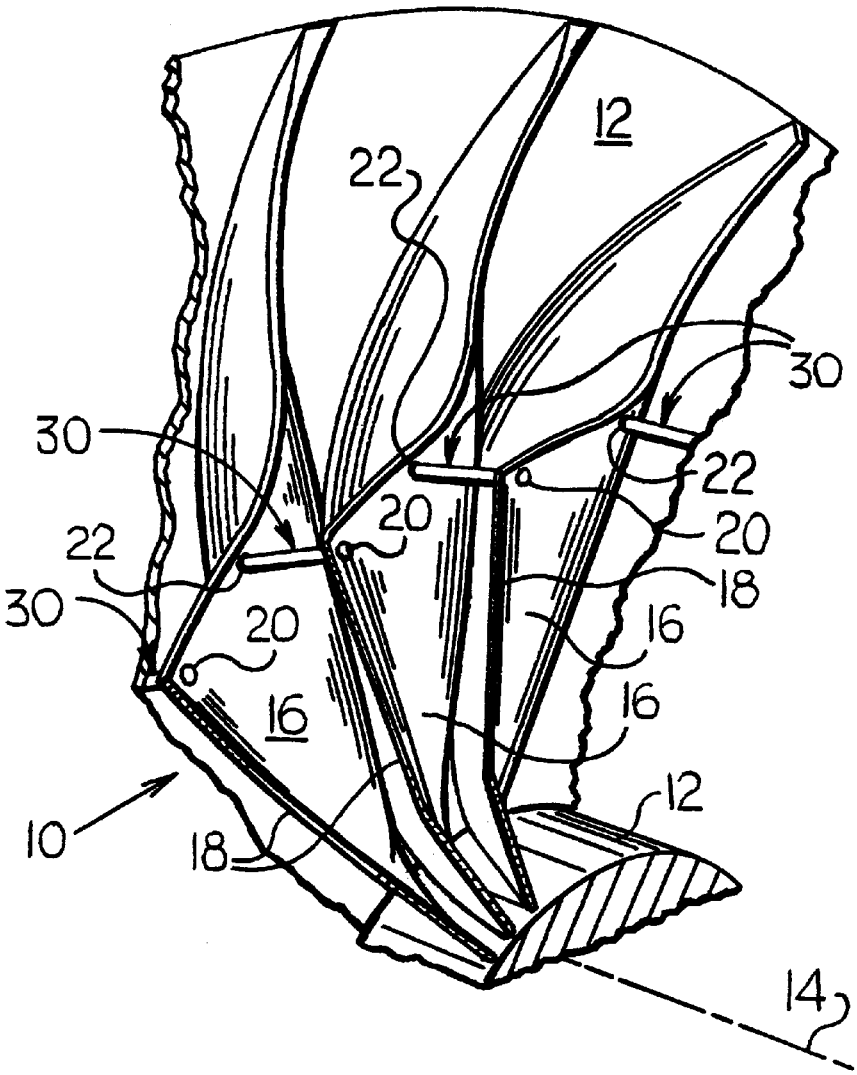
FIG. 1 is a partial sectional view of a radial impeller according to the present invention.

A radial impeller system 10 according to the present invention is illustrated in FIG. 1 of the drawings. A blade supporting hub 12 is attached to a rotary turbomachinery shaft having a centerline shown by a chain line 14. Impeller blades 16 are positioned at spaced locations about the circumference of the shaft and are secured to supporting hub 12 in a conventional fashion. For example, blades 16 may be integral to or welded to hub 12. Blades 16 may be formed with any desired shape which meets the structural requirements of the specific turbomachine. However, blades 16 will generally have a long, thin cantilevered construction having a substantial curvature in the axial/tangential plane about their longitudinal axis, as illustrated in FIG. 1.

As shown in FIG. 1 of the drawings, each blade 16 includes a first lashing pin aperture 20 positioned in proximity to the leading edge 18 near the tip of the blade 16 radially spaced from the supporting hub 12. Each blade 16 includes a second lashing pin aperture 22 which is located on the blade at a distance in an axial/tangential plane from the leading edge 18 which is greater than the distance between the leading edge 18 and first lashing pin aperture 20. The radial distances of the first and second lashing pin apertures 20 and 22 are equal in order to minimize the load on the lashing pin 30. The location of second lashing pin aperture 22 on each blade has a lower vibration during operation of radial impeller system 10 than the vibration characteristics of the area of blade 16 at the first lashing pin aperture 20.

Each blade 16 is coupled to the two adjacent blades 16 by lashing pins 30. Each lashing pin 30 extends from first lashing pin aperture 20 in one blade 16 to second lashing pin aperture 22 in an adjacent blade 16. This construction, together with the location of first and second lashing pin apertures 20 and 22 on each blade 16, creates a progressive zigzag pattern of lashing pins 30 between blades 16, as illustrated in FIG. 1 of the drawings.

Figure 2A:
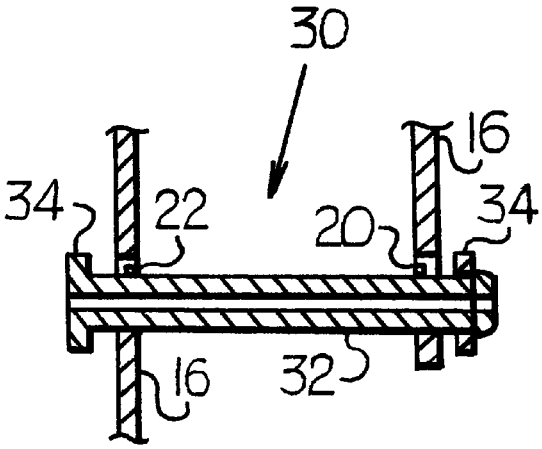
FIG. 2*a* is an enlarged section view of a portion of the radial impeller illustrated in FIG. 1 in the static condition showing a hollow lashing pin.
Figure 2B:
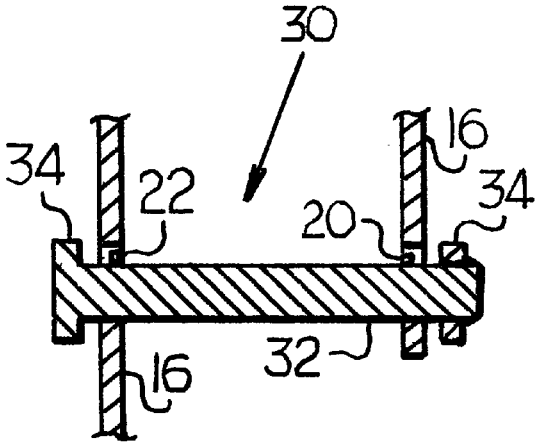
FIG. 2*b* is an enlarged section view of a portion of the radial impeller illustrated in FIG. 1 in the static condition showing a solid lashing pin.

The construction of individual lashing pins 30 is best illustrated in FIGS. 2*a* and 2*b* of the drawings. Each lashing pin 30 may include, as shown in FIG. 2*a,* a hollow body portion 32 and a pair of opposed fixed head portions 34 at opposite ends of body portion 32. The body portion 32 of lashing pin 30 creates a lower stress in the lashing pin 30 than the stress in a solid lashing pin. The diameter of each head portion 34 is larger than an associated lashing pin aperture 20 or 22 to prevent the head portion from passing through an aperture. Fixed head portion 34 can be welded onto body portion 32 or secured in other equivalent fashions such as by brazing or a mechanical securing arrangement. One of the head portions 34 may be formed integrally with the body portion 32 to minimize the number of welds. Lashing pins 30 are loosely fitted within first and second lashing pin apertures 20 and 22, whereby each blade 16 can move relative to an associated lashing pin 30. Other lashing pin constructions are contemplated in the present invention. As shown in FIG. 2*b,* a solid lashing pin may be used which can provide larger constraining and frictional loads. The diameter of the lashing pin, specifically a solid lashing pin, may be smaller. The lashing pin 30 may be formed with the two fixed head portions 34 integrally formed on a separate half of the body portion 32 wherein the separate halves of the body portion 32 are coupled together at the center of the pin, such as by welding, after assembly.

The present invention contemplates modifying existing impeller systems for reducing blade vibrations in a radial impeller having cantilevered blades. This method includes providing a first lashing pin aperture 20 in each blade 16 adjacent to a blade leading edge 18 and providing a second lashing pin aperture 22 in each blade 16 at a location farther from the leading edge 18 of the blade 16 in the axial/tangential plane than the location of first lashing pin aperture 20, whereby the location of second lashing pin aperture 22 will have lower vibrations during operation than the vibration level of the area of first lashing pin aperture 20. Body portion 32 of lashing pin 30 can be inserted through first lashing pin aperture 20 of each blade 16 and through second lashing pin aperture 22 of an adjacent blade 16 so that the lashing pin is loosely fitted within each first and second aperture 20 and 22. A fixed head portion 34 is attached to the opposed ends of each body portion 32 such as by welding or the like. One fixed head portion 34 may be integrally formed on the body portion 32, as shown in FIGS. 2*a* and 2*b*. As noted above, each head potion 34 has a diameter greater than that of the associated first or second aperture 20 or 22 to hold the blades 16 in the appropriate orientation.

As illustrated in FIGS. 2*a* and 2*b* of the drawings, a gap may exist between a fixed head portion 34 and an associated blade 16 during the static or nonuse condition of radial impeller system 10. This gap may be adjusted at operating speed by canting each blade 16 at an angle to the radial direction.

In the static condition, blades 16 and lashing pins 30 are completely unstressed. Consequently, by appropriately adjusting the gap between each blade 16 and an adjacent fixed head portion 34, the stress condition under normal operating conditions can be better controlled. Contact stresses between lashing pins 30 and blades 16 can be adjusted by modifying the relative diameters of the body portion 32 and the first and second apertures 20 and 22.

In the operation of radial impeller system 10, centrifugal force loads are exerted by lashing pins 30 on blades 16 which result in frictional constraining forces at both first lashing pin aperture 20 and second lashing pin aperture 22 to dampen vibratory motion. Natural frequencies are also increased due to the stiffening action of lashing pins 30. Friction forces between blade 16 and lashing pin 30 must be overcome before relative motion occurs between each blade and a lashing pin 30. The location of lashing pins 30 near the blade tips optimizes the constraining loads as well as the stresses and natural frequencies created within the system. Due to the location of first lashing pin aperture 20 and second lashing pin aperture 22, as discussed above, each location will have a different value of vibration amplitude as compared to an adjacent blade 16 at a given natural frequency. This is especially true for the first bending mode of a blade 16, even if adjacent blades 16 have identical frequencies.

Figure 3:
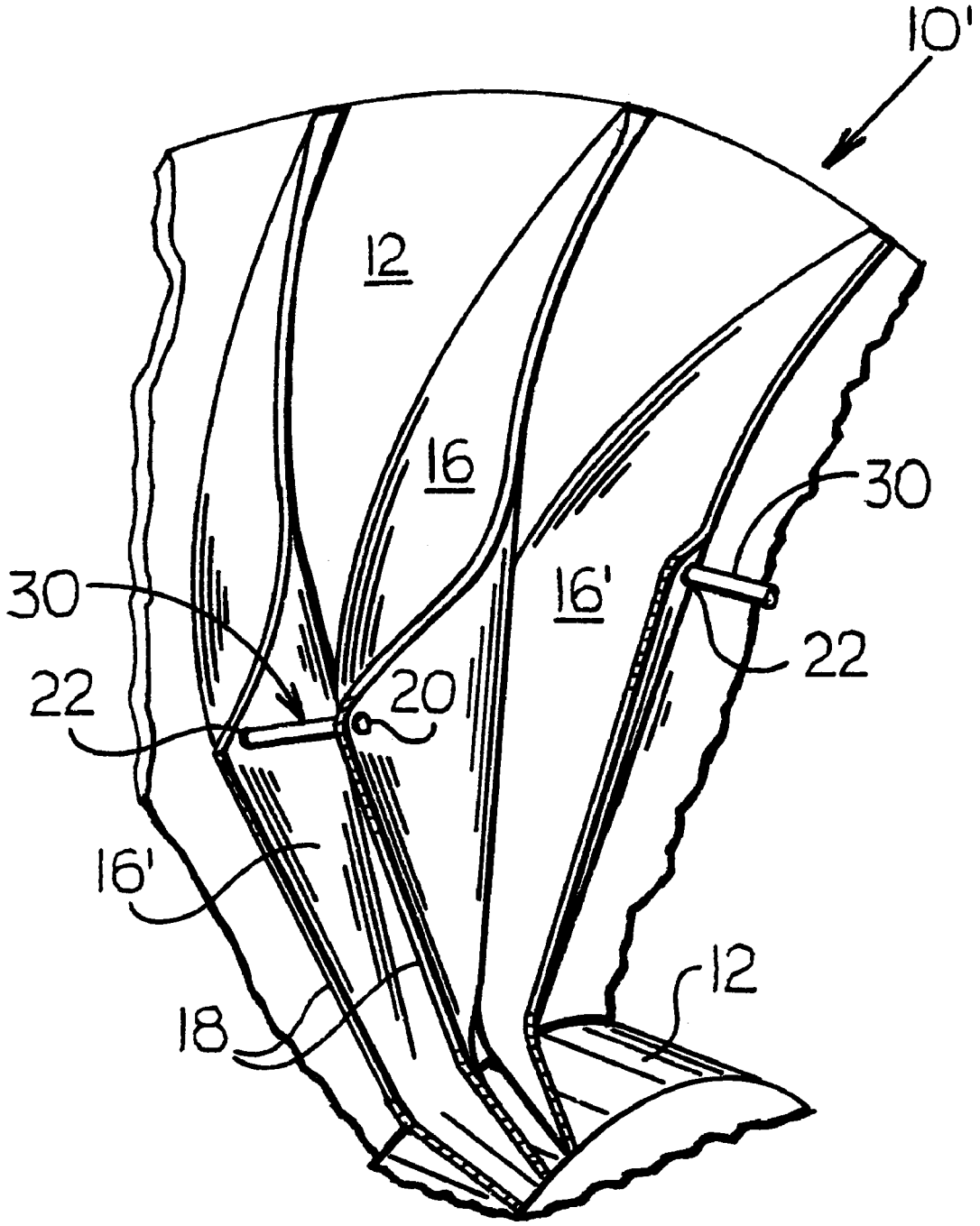
FIG. 3 is a partial sectional view similar to FIG. 1 showing a modified radial impeller according to the present invention.

FIG. 3 of the drawings illustrates a modified radial impeller system 10' which includes alternating impeller blades 16 with partial impeller blades 16'. Partial impeller blades 16' omit a forward portion of the blade adjacent to the leading edge 18 to improve the aerodynamics of the impeller system. Each impeller blade 16 includes a first lashing pin aperture 20, as discussed above, and each partial impeller blade 16' includes a second lashing pin aperture 22, as discussed above. A lashing pin 30 couples each impeller blade 16 to an adjacent partial impeller blade 16' through first and second lashing pin apertures 20 and 22 in the manner described above.

Having described the components of the radial impeller systems 10 and 10' according to the present invention, the present invention should not be limited to the embodiments specifically illustrated herein. It will be appreciated by those of ordinary skill in the art that various modifications may be made to the present invention without departing from the spirit and scope thereof. The scope of the present invention should be interpreted in connection with the attached claims.

What is claimed is:

1. A method of reducing blade vibration in a radial impeller having an impeller shaft and a plurality of blades circumferentially spaced around said shaft, said method comprising the steps of:

a) providing a first aperture in each of said blades adjacent to a leading edge of said blade;

b) determining a location on each said blade which has a lower vibration during operation than the vibration of said area of said first aperture;

c) a providing a second aperture in each of said blades at said determined location on said blade having lower vibration during operation than the vibration of said area of said first aperture;

d) inserting a lashing pin through said first aperture in one of said blades and said second aperture in an adjacent one of said blades, wherein said lashing pin is loosely fitted within said first and second apertures;

e) securing a head to each end of said lashing pin, wherein each of said heads has a diameter greater than that of said first and second apertures; and f) repeating steps d) and e) for each said blade.

2. The method of claim 1 further including the step of boring out the center of each of said lashing pins.

3. The method of claim 2 wherein each of said heads is welded to said end of one of said lashing pins.

4. The method of claim 1 wherein said second aperture in each of said blades is located at a greater distance from said leading edge than said first aperture in each of said blades.

5. The method of claim 1 including adjusting the gap between each of said heads and an adjacent blade in the static condition of said impeller by canting each of said blades.

* * * * *

UNITED STATES PATENT AND TRADEMARK OFFICE

CERTIFICATE OF CORRECTION

PATENT NO. : 5,984,638
DATED : November 16, 1999
INVENTOR(S) : M. Theodore Gresh et al.

It is certified that error appears in the above-identified patent and that said Letters Patent is hereby corrected as shown below:

Column 3 Line 4 "DESCRIPTION OP" should read --DESCRIPTION OF--.

Claim 1, Column 5 Line 17, "c) a providing" should read --c) providing--.

Signed and Sealed this

Eleventh Day of July, 2000

*Attest:*

Q. TODD DICKINSON

*Attesting Officer*

*Director of Patents and Trademarks*